United States Patent [19]

Worst

[11] 4,331,330

[45] May 25, 1982

[54] BASEBALL BAT WITH IMPROVED HITTING SURFACE AND LESS MASS

[76] Inventor: Joseph C. Worst, 3606 Nandina Dr., Louisville, Ky. 40222

[21] Appl. No.: 38,655

[22] Filed: May 14, 1979

[51] Int. Cl.[3] ..... A63B 59/06

[52] U.S. Cl. ..... 273/72 R

[58] Field of Search ..... 273/26 B, 67 D, 67 DC, 273/72 R, 73 J, 75

[56] References Cited

U.S. PATENT DOCUMENTS

| | | | |
|---|---|---|---|
| 400,354 | 3/1889 | Morris | 273/72 R |
| 442,046 | 12/1890 | Heighington et al. | 273/67 D |
| 1,949,325 | 2/1934 | Paul | 273/67 D |
| 2,169,774 | 8/1939 | Taylor | 273/72 R |
| 2,394,184 | 2/1946 | Janis | 273/72 R |
| 3,880,423 | 4/1975 | Kreag | 273/72 R X |
| 4,090,710 | 5/1978 | Williams | 273/75 |
| 4,098,503 | 7/1978 | Antone | 273/26 B X |
| 4,186,923 | 2/1980 | Garner et al. | 273/67 D |

*Primary Examiner*—Richard J. Apley

*Attorney, Agent, or Firm*—Richard L. Caslin

[57] ABSTRACT

A baseball bat is shown having at the ball hitting portion a transverse cross section geometry of maximum frontal dimension and less mass than a full circular baseball bat, so as to improve the batting average, the speed, the distance and the directional accuracy of the batter. Moreover, the intermediate portion of the bat has optimum strength for its weight.

2 Claims, 10 Drawing Figures

BASEBALL BAT WITH IMPROVED HITTING SURFACE AND LESS MASS

BACKGROUND OF THE INVENTION

1. Field of the Invention

This invention relates to the design of baseball bats, and particularly bats made of wood material of less mass than conventional bats having a ball hitting portion with a circular transverse cross section.

2. Description of the Prior Art

The home plate of a regulation baseball diamond has a maximum dimension of about 18 inches parallel to the flight of a pitched baseball.

Many major league baseball pitchers throw a baseball at about 90 miles per hour. This converts to 132 feet per second or 1584 inches per second. A baseball moving at this velocity will pass over home plate in about 1/100th of a second.

A baseball batter has the best probability of hitting a pitched baseball if he or she can swing a maximum diameter bat permitted by league regulations, quickly enough to hit the incoming high-velocity pitched baseball.

The most powerful of batters are able to swing a maximum diameter and weight of cylindrical bat from the posed position to the hitting zone in the available time to hit the ball. Less powerful batters usually select a smaller diameter cylindrical bat which has a reduced mass and inertia, but this reduces the probability of hitting a pitched ball.

It is known to have baseball bat designs with ball hitting portions of non-circular transverse cross section as is shown in the expired Morris U.S. Pat. No. 400,354 of 1889. This Morris bat has a lower handle portion of circular cross section and an intermediate and ball hitting portions of oval cross section to present a larger striking-face. The Morris bat has a circular handle portion which gradually merges into an oval form. Hence it increases to about double the width with very little increase of thickness at the striking portion. This Morris patent does not discuss the importance of using a maximum diametrical dimension of the ball hitting portion nor does it discuss the importance of reducing the mass and inertia of the bat. This Morris bat has a weak intermediate portion 2, as is seen in FIG. V, so as to increase the elasticity of the bat. Hence, the Morris bat is prone to splinter when the pitched ball strikes the intermediate portion of the bat.

Another prior art patent is the Salsinger U.S. Pat. No. 3,104,876 which has a ball hitting portion with a square transverse cross section and a lower handle portion with a corrugated finger grip attached to the outside of and extending axially along the handle.

Another prior art patent is the Mann U.S. Pat. No. 3,554,545 which has a standard ball hitting portion of circular cross section and a lower handle portion with a dog leg configuration which imparts a laterally offset contour thereto relative to the longitudinal axis of the bat.

The Kreag U.S. Pat. No. 3,880,423 describes a hollow bat having a ball hitting portion with three striking surfaces, one of which is of foam rubber. This bat probably would not meet official major league baseball regulations.

OBJECTS OF THE PRESENT INVENTION

The principal object of the present invention is to provide a batter with a customized bat having a ball hitting portion with a maximum diametrical dimension, having a curvature of a large radius and having the correct amount of mass in the bat for a particular batter to swing effectively.

A further object of the present invention is to provide a bat of the class described with less mass than a standard maximum diameter cylindrical bat, and having a ball contacting surface that will increase the directional accuracy and distance of the batter.

A further object of the present invention is to provide a novel baseball bat of the class described with a stronger intermediate portion but with less mass in that area than in a standard baseball bat.

A still further object of the present invention is to provide a baseball bat of the class described with a ball hitting portion of variable cross section and a larger cross-sectional area that is localized at the optimum hitting area of the bat so as to increase the mass of the bat at this optimum hitting area.

SUMMARY OF THE INVENTION

The present invention provides a novel baseball bat with a lower handle portion, an intermediate portion, and a ball hitting portion having a transverse cross section periphery that is divided into two dissimilar half segments where the first half segment is formed substantially as a semi-circle and the second half segment is formed substantially as a semi-ellipse with the major axis of the semi-ellipse being substantially equal to the diameter of the semi-circle.

BRIEF DESCRIPTION OF THE DRAWINGS

This invention will be better understood from the following description taken in conjunction with the accompanying drawings and its scope will be pointed out in the appended claims.

DESCRIPTION OF THE PREFERRED EMBODIMENTS

Figure 1:
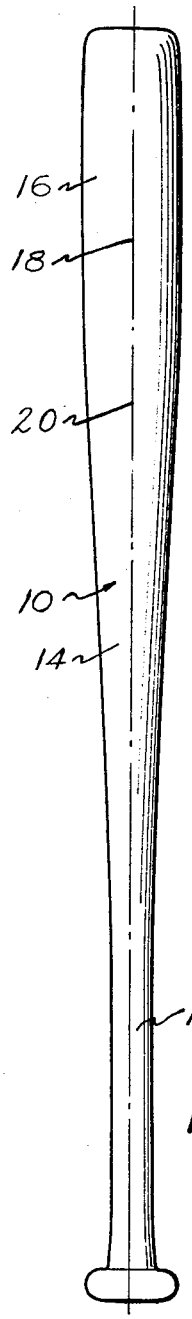
FIG. 1 is a front elevational view of the preferred embodiment of the present invention.

Turning now to a consideration of the drawings and, in particular, to the front elevational view of FIG. 1, there is shown a baseball bat 10 showing the preferred embodiment of the present invention. The bat 10 has a lower handle portion 12, an intermediate portion 14 and a ball hitting portion 16. These three bat portions 12, 14 and 16 are substantially equal in length, although this relationship could vary without departing from the present invention. This front side 18 of the bat hitting portion 16 is the side of the bat that would address the pitched ball. The lower handle portion 12 is generally circular in transverse cross section, as in standard bat construction. The bat is shown in the front view of FIG. 1 with a longitudinal centerline 20 which is substantially equidistant from the two sides of the bat.

Figure 2:
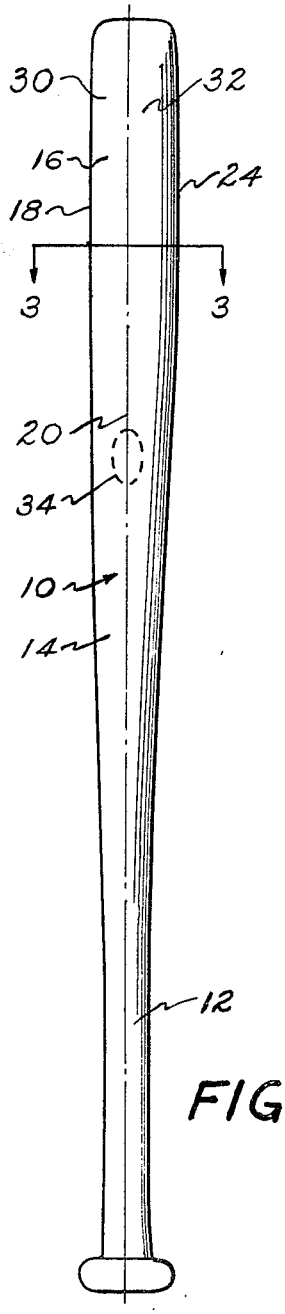
FIG. 2 is a right side elevational view of the baseball bat of FIG. 1.

FIG. 2 is an elevational view of the right side of the bat of FIG. 1. Notice that the longitudinal centerline 20 of the bat in this FIGURE is not equidistant from the front side 18 and the rear side 24 in the intermediate portion 14 or the ball hitting portion 16. For an understanding of the configuration of the hitting portion 16, reference is made to the transverse cross-sectional view of FIG. 3.

Figure 3:
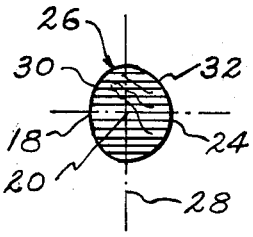
FIG. 3 is a transverse cross-sectional view taken on the line 3—3 of FIG. 2 through the ball hitting portion of the bat.

This first modification 26 of FIG. 3 is the preferred embodiment of this invention. In this transverse cross-sectional view the longitudinal centerline 20 appears as a point. A vertical cross plane 28 that includes the longitudinal centerline 20 serves to divide the transverse cross section schematically into two unequal half segments, a smaller front ball hitting segment 30 and a larger rear segment 32. The front ball hitting segment 30 is formed as a semi-ellipse, while the rear segment 32 is formed as a semi-circle. The major axis of the semi-ellipse 30 is substantially equal to the diameter of the semi-circle 32.

Notice in this preferred embodiment 26 of FIG. 3, that the said major axis or width of the bat is greater than the diameter of a circle would be if the circle were of the same area as the area of this first modification 26. In other words, the bat 10 of modification 26 has a wider hitting surface than most standard bats without any increase in the weight of the bat.

Some batters may want to have the advantage of a bat, like modification 26, with a maximum width and less weight, but yet prefer to hit the baseball with the semi-circular surface 32 of the rear segment. For such cases, the bat 10 is marked with two diametrically opposite indicia-marked areas 34 on the two sides of the bat. These markings 34 usually comprise the bat manufacturer's logo, and they will serve as a guide to the batter to orient the bat with the preferred ball hitting surface facing the pitcher, and also to insure that the grain of the wood of the bat is properly oriented so as to avoid accidental splintering of the wood. The preferred orientation of the grain of the wood is illustrated in FIG. 3, where the grain extends from front to rear, and generally perpendicular to the vertical cross plane 28. Thus, a bat with double markings 34 has maximum utility for batters who want to use both the front 30 and rear 32 surfaces as batting surfaces, as well for both right and left hand batters.

Figure 4:
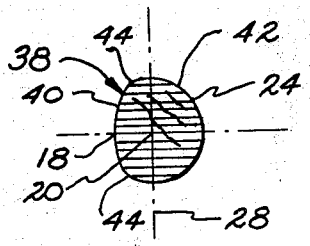
FIG. 4 is a transverse cross-sectional view similar to FIG. 3, of a second modification of the present invention.

FIG. 4 shows a transverse cross-sectional view, similar to FIG. 3, that is also taken on the line 3—3 of FIG. 2 showing a second modification 38 of the present invention. In this second modification 38, the vertical cross plane 28 divides the transverse cross section schematically into two unequal half segments; a smaller front ball hitting segment 40 and a larger rear segment 42. The rear segment 42 is formed as a semi-circle that has an arc greater than 180°; that is, the arc passes to the left of the plane 28 to about point 44. The front segment 40 is formed as a shortened semi-circle that has a radius greater than the radius of the semi-circle of rear segment 42 and it blends with the segment 42 adjacent points 44, 44 by use of curved surfaces of short radii. This modification 38 is a minimum change from a standard circular bat. It can give the long ball hitter the advantage of a little more bat width, a flatter front ball hitting surface 18, and a bat weight suited to hit the ball a long distance.

Figure 5:
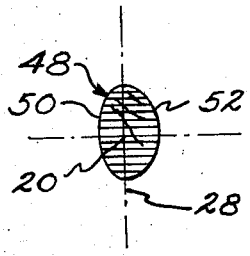
FIG. 5 is another transverse cross-sectional view similar to FIG. 3, of a third modification of the present invention.

FIG. 5 shows a third modification 48, where the vertical cross plane 28 divides the transverse cross section schematically into two unequal half segments; a smaller front ball hitting segment 50 and a larger rear segment 52. These two segments 50 and 52 are formed by two semi-ellipses having substantially equal major axes and semi-minor axes of unequal length. The semi-minor axis of front segment 50 is shorter than the semi-minor axis of rear segment 52. Either surface 50 or 52 could be used as the ball hitting surface. This third modification is ideal for weak batters, such as many pitchers, who need a bat of maximum width, a rather flat hitting surface as well as a light weight in order to increase the speed of swinging the bat. This bat 48 would also be ideal for bunting.

Figure 6:
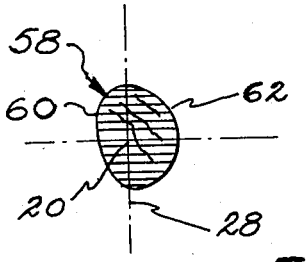
FIG. 6 is another transverse cross-sectional view similar to FIG. 3, of a fourth modification of the present invention.

FIG. 6 shows a fourth modification 58, where the vertical cross plane 28 divides the transverse cross section schematically into two unequal half segments; a smaller front ball hitting segment 60 and a larger rear segment 62. The front segment 60 is formed as a semi-egg shaped oval, while the rear segment 62 is formed as a semi-circle. This semi-egg shaped oval 60 is suited to give the batter the capability of hitting texas-leaguers over the heads of the infielders.

Figure 8:
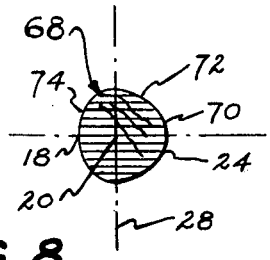
FIG. 8 is a transverse cross-sectional view taken on the line 8—8 of FIG. 7.
Figure 7:
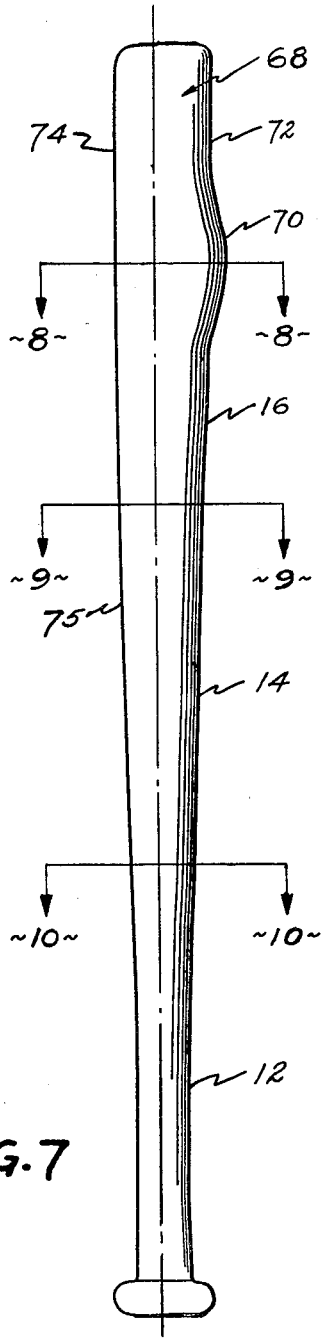
FIG. 7 is a right side elevational view similar to FIG. 2 of a fifth modification of the present invention having an enlarged mass that is localized on the back side at the optimum hitting area of the bat.

FIGS. 7 and 8 show a fifth modification 68 of the present invention. FIG. 7 is a vertical side elevational view of the bat showing a bulbous enlargement 70 on the rear segment 72 in the vicinity of the "sweet spot" or optimum hitting area of the bat. Looking at the transverse cross-sectional view of FIG. 8, the vertical cross plane 28 divides the cross section schematically into two unequal half segments; a smaller front ball hitting segment 74 and a larger rear segment 72. The front segment 74 is shown as a semi-ellipse similar to segment 30 in FIG. 3, while the rear segment 72 is shown first as a semi-circle at the top and bottom of the ball hitting portion, and then as a semi-ellipse turned 90° so its minor axis substantially overlies the major axis of the segment 74. This semi-ellipse is formed by a bulbous enlargement 70 at the optimum hitting area so as to increase the mass of the bat in that optimum hitting area.

Figure 9:
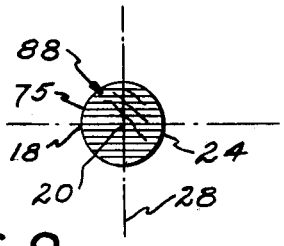
FIG. 9 is a transverse cross-sectional view taken on the line 9—9 of FIG. 7 showing that the ball hitting portion may have more than one transverse cross section, one of which may be circular, as in FIG. 9.

As mentioned earlier, FIG. 9 is a transverse cross-sectional view taken on the line 9—9 of FIG. 7, of another modification 88 showing the ball hitting segment 74 as having a second configuration 75, which in this case is a complete circular configuration. Instead of being circular, the configuration 75 could be the same as modifications 26, 48 or 58.

Figure 10:
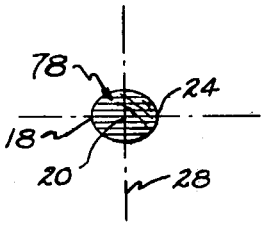
FIG. 10 is a transverse cross-sectional view taken on the line 10—10 of FIG. 7 through the intermediate portion of the bat.

FIG. 10 is a transverse cross-sectional view taken on the line 10—10 of FIG. 7 through the intermediate portion 14 of the bat 10 of the present invention. This FIG. 10 shows an oval shaped cross section 78 which has its maximum dimension perpendicular to the vertical cross plane 28, thereby extending from the front surface 18 to the rear surface 24. This oval cross section is approximately the same area as the area of a conventional circular cross section, but it is stronger in the high force direction, and thereby resists splitting, when the bat is formed of wood. This oval formation 78 could be used with any of the five modifications of ball hitting portions 26, 38, 48, 58, and 68 of FIGS. 3, 4, 5, 6 and 8 respectively.

It should be understood by those skilled in this art that while most of the foregoing description was directed toward baseball bats formed of wood, the same configural inventions described above could be utilized in the hollow aluminum bats that are also available on the market.

Most standard baseball bats of wood break in the intermediate portion 14 when the ball strikes this area. Sometimes when a bat breaks, the heavy end of the bat flies out into the infield and threatens serious bodily harm to the opposing team members. This oval intermediate portion 78 provides a new bat design that is stronger than standard baseball bats without adding mass to slow down the batter's swing. A standard bat that is circular along its entire length could be made stronger if the diameter of the intermediate portion were increased, but this would increase the mass and thereby require more force to accelerate the bat from the posed position to the maximum velocity position or baseball hitting zone.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A baseball bat comprising:

a. a lower handle portion;

b. an intermediate portion; and c. a ball-hitting portion;

d. said ball-hitting portion having a transverse convex curvilinear cross section schematically divided into two ball-hitting half segments by a vertical cross plane that includes the longitudinal centerline of the bat, whereby one of the two ball-hitting half segments is less rounded and of a smaller sectional area than the other ball-hitting half segment while the two half segments join with each other generally on the vertical cross plane and are generally free of sharp corners, the said front ball-hitting half segment is formed substantially by a semi-ellipse, and the rear half segment is formed substantially by a semi-circle, where the major axis of the semi-ellipse substantially overlies both the diameter of the semi-circle and the said vertical cross plane.

2. The invention of claim 1 wherein the bat material is wood and the grain of the wood extends generally between the front ball-hitting surface and the rear surface so as to be generally perpendicular to the said vertical cross plane.

* * * * *